United States Patent [19]

Sanbongi et al.

[11] 4,025,368

[45] May 24, 1977

[54] WELDABLE STEEL EXCELLENT IN THE TOUGHNESS OF THE BOND IN A SINGLE LAYER WELDING WITH A LARGE HEAT-INPUT

[75] Inventors: Koji Sanbongi, Matsudo; Tokushi Funakoshi, Ichihara; Tomoo Tanaka; Syuzo Ueda, both of Chiba, all of Japan

[73] Assignee: Kawasaki Steel Corporation, Kobe, Japan

[22] Filed: May 30, 1975

[21] Appl. No.: 582,256

[30] Foreign Application Priority Data

June 8, 1974 Japan ..... 49-65468

[52] U.S. Cl. ..... 148/36; 75/123 B; 75/123 E

[51] Int. Cl.[2] ..... C22C 38/02

[58] Field of Search ..... 75/123 E, 123 B; 148/36

[56] References Cited

UNITED STATES PATENTS

| | | | |
|---|---|---|---|
| 2,360,717 | 10/1944 | Phelps | 75/123 E |
| 2,686,115 | 8/1954 | Clark | 75/123 E |
| 2,861,908 | 11/1958 | Mickelson et al. | 75/123 E |
| 2,970,903 | 2/1961 | Mickelson et al. | 75/123 E |
| 3,664,830 | 5/1972 | Kambayashi | 75/124 |
| 3,773,500 | 11/1973 | Kanazawa et al. | 75/123 B |

FOREIGN PATENTS OR APPLICATIONS

| | | | |
|---|---|---|---|
| 45-37428 | 11/1970 | Japan | 75/123 E |

*Primary Examiner*—W. Stallard

[57] ABSTRACT

A weldable steel excellent in the toughness of the bond in a single layer welding with a large heat-input more than 60,000 J/cm, which contains 0.03 to 0.22% of carbon, 0.02 to 0.80% of silicon and 0.40 to 2.00% of manganese in coexistance of 0.005 to 0.1% of rare earth metal and 0.0005 to 0.01% of boron, the remainder being substantially iron. Said weldable steel can be further improved by containing at least one of not more than 0.1% of niobium, not more than 0.1% of vanadium, not more than 0.5% of copper, not more than 1.0% of nickel, not more than 0.8% of chromium, not more than 0.5% of molybdenum, not more than 0.1% of selenium, not more than 0.1% of aluminum, not more than 0.1% of titanium and not more than 0.1% of zirconium.

2 Claims, 5 Drawing Figures

Figure 1:
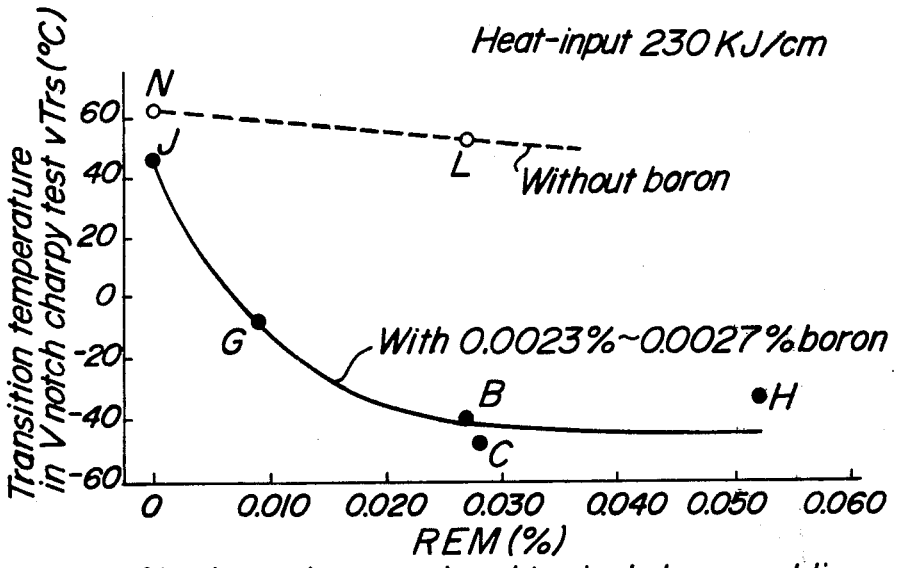

Notch toughness at bond in single layer welding

Notch toughness at bond in single layer welding

Notch toughness at bond in single layer welding (a)

Si-Mn Steel (b)

Steel with boron alone (c)

Steel with rare earth metal alone (d)

Steel with both boron and rare earth metal (a)

Si-Mn Steel (b)

Steel with boron alone (c)

Steel with rare earth metal alone (d)

Steel with both boron and rare earth metal

WELDABLE STEEL EXCELLENT IN THE TOUGHNESS OF THE BOND IN A SINGLE LAYER WELDING WITH A LARGE HEAT-INPUT

The present invention relates to a weldable steel for large heat-input welding with a heat-input more than 60,000 J/cm and proposes a weldable steel which is excellent in notch toughness of the welded part even in a single layer welding conducted under such a large heat-input and is advantageously used for welding with a large heat-input in any case of single layer and multiple layers.

Recently, in manufacture of large size structures, for example, ships, bridges, pressure vessels, penstocks, or oil transfer pipes, an automatic welding by a large heat-input, such as one side submerged arc welding, electrogas arc welding or electroslag welding, has been widely used in order to reduce the number of welding steps and welding cost.

However, heretofore, when steels of 40 Kg/mm² class and high tensile strength steels of 50 Kg/mm² to 60 Kg/mm² class, which have been used for such a large size structure, are welded with a large heat-input more than 60,000 J/cm, the weld heat affected zone, particularly the bond becomes a mixed structure of a large network of proeutectoid ferrite and an upper bainite due to coarsening of austenite grains and the toughness considerably degrades and the large heat-input welding has not been accepted in view of the steel material.

The inventors have diligently studied application of the large heat-input welding to these steel materials and as the result, it has been found that by adding an appropriate amount of both rare earth metal and boron to the composition of these conventional steels, even when the single layer welding is applied with a large heat-input more than 60,000 J/cm, the structure of the bond becomes a mixed structure of fine ferrite and pearlite and the toughness of the bond is remarkably improved.

A further study as been made and it has been found that the is no change in the effect influencing upon the bond welded with the large heat-input in any case of the hot rolled steel or heat treated steels, such as normalizing step or quenching-tempering step.

This invention is based on this discovery.

The first aspect of the present invention consists in a weldable steel excellent in the toughness of the bond in a single layer welding with a large heat-input more than 60,000 J/cm, which contains 0.03 to 0.22% of carbon, 0.02 to 0.80% of silicon, 0.40 to 2.00% of manganese in coexistence of 0.005 to 0.1% of rare earth metal and 0.0005 to 0.01% of boron, the remainder being substantially iron.

The second aspect of the present invention consists in a weldable steel excellent in the toughness of the bond in a single layer welding with a large heat-input more than 60,000 J/cm, which contains 0.03 to 0.22% of carbon, 0.02 to 0.80% of silicon, 0.40 to 2.00% of manganese in coexistence of 0.005 to 0.1% of rare earth metal and 0.0005 to 0.01% of boron and further contains at least one of not more than 0.1% of niobium, not more than 0.1% of vanadium, not more than 0.5% of copper, not more than 1.0% of nickel, not more than 0.8% of chromium, not more than 0.5% of molybdenum, not more than 0.1% of selenium, not more than 0.1% of aluminum, not more than 0.1% of titanium and not more than 0.1% of zirconium, the remainder being substantially iron.

The reason why the range of the components of the steel in the present invention is limited as described above is as follows.

The carbon content is limited to 0.03 to 0.22%. The lower limit of 0.03% of carbon is necessary in view of the strength for such a kind of structural steel and such a lower limit also is necessary in view of steel making. The upper limit is defined to be 0.22% in view of the welding hardenability and the susceptibility to welding cracks. The more preferable range is 0.05 to 0.18%.

Silicon is necessary in an amount of not less than 0.02% in view of steel making and an amount of up to 0.80% may be added in order to provide an appropriate strength but when the amount of silicon exceeds 0.80%, the toughness of the base metal is considerably deteriorated, so that the amount of silicon is defined to be 0.02 to 0.80%, preferably 0.15 to 0.40%.

Manganese needs not less than 0.40% in order to give the ductility and the strength to the base metal, while when manganese exceeds 2.00%, the welding hardenability is considerably increased, so that the range of manganese is limited within the range of 0.40 to 2.00%. The preferable range is 0.70 to 1.70% in view of the toughness of the bond part in the large heat-input welding.

Rare earth metal in coexistence with boron noticeably improves the toughness of the bond welded with a large heat-input more than 60,000 J/cm but in the case of less than 0.005% of rare earth metal, the effect is not substantially attained, while when the amount of rare earth metal exceeds 0.1%, the toughness of the base metal is deteriorated, so that the range is defined to be 0.005 to 0.1%.

Boron considerably improves the toughness of the bond welded with the large heat-input in coexistence with rare earth metal but boron has substantially no effect in less than 0.0005%, while when boron exceeds 0.01%, the toughness of the base metal is considerably deteriorated, so that the range is defined to be 0.0005 to 0.01%. Furthermore, when rare earth metal and boron are contained in the range of 0.010 to 0.050% and 0.0010 to 0.0050% respectively, the toughness of the bond welded with the large heat-input is very excellent.

The reason for limiting the content of the selective components will be explained.

Niobium and vanadium are particularly effective for improving the strength of the base metal and the effect can be developed in an amount of not more than 0.1% but when said amount exceeds 0.1%, the notch toughness of the base metal is deteriorated and the susceptibility to welding cracks becomes larger and such an amount is not preferable.

Even in the steel for a large heat-input welding, when such a welding is practically effected, provisional welding of a small heat-input is partially effected or a part of the base metal is welded with a small heat-input, so that it is preferable that the steel is excellent also in a small heat-input weldability. The addition of not more than 0.1% of niobium or vanadium, preferably not more than 0.03% of niobium or not more than 0.05% of vanadium serves to improve the susceptibility to welding cracks in a small heat-input welding of about 15,000 to 20,000 J/cm.

Copper also contributes to improve the strength but when copper exceeds 0.5%, the susceptibility to welding cracks becomes larger, so that the amount of copper is limited to not more than 0.5%, preferably not more than 0.3%. Furthermore, copper contributes to improve the corrosion resistance of the steel in an amount of not more than 0.5%.

Nickel improves the strength and the notch toughness of the base metal but is an expensive element and the amount is limited to not more than 1.0% in view of the economy of this kind of steel and an amount of not more than 0.6% is preferably in view of the hardenability in the bond welded with a small heat-input and the susceptibility to welding cracks.

Chromium is an effective element for increasing the strength but increases the welding hardenability and the susceptibility to welding cracks, so that the amount of chromium is limited to not more than 0.8%, preferably not more than 0.6%.

Molybdenum is useful for increasing the strength but deteriorates the toughness of the base metal and the weld heat effected zone, so that the amount is limited to not more than 0.5%, preferably not more than 0.1%.

Aluminum, particularly acid soluble aluminum is effective element for improving the strength and toughness due to the deoxidation and the grain refining but the effect saturates in an amount of more than 0.1%, so that the amount is limited to not more than 0.1%.

Titanium is not only effective for improving the strength due to the deoxidation and the grain refining but also is effective for improving the ductility of the heat affected zone in a small heat-input welding and for reducing directionality of the mechanical property particularly, shelf emergy in Charpy test) but when the amount exceeds 0.1%, the notch toughness of the base metal is deteriorated, so that the amount is limited to not more than 0.1%, preferably not more than 0.04%.

Zirconium is effective for improving the strength of the steel and further serves to improve the shape of sulfide in the steel and prevent the coarsening of the crystal grains. When the amount exceeds 0.1%, the notch toughness of the base metal is considerably deteriorated, so that the amount is limited to not more than 0.1%, preferably not more than 0.04%.

Selenium is effective for increasing the strength of the steel and for improving the corrosion resistance of the steel but when the amount exceeds 0.1%, the notch toughness of the base metal is considerably deteriorated, so that the amount is limited to not more than 0.10%.

In the present invention, such a degree of inevitable impurities that they are contained in the usual steel making, is tolerated, but phosphorus increases the susceptibility to hot cracks of weldment, so that the amount of phosphorus should be not more than 0.035% and when an amount of sulfur becomes larger, the effect for improving the toughness of the weld heat affected zone in a large heat-input welding of rare earth metal and boron lowers and further upon steel making, a large amount of inclusion is produced and the inner property of the steel is deteriorated, so that the amount of sulfur is limited to not more than 0.015%, preferably not more than 0.010%.

The present invention relates to steels for welding with a large heat-input more than 60,000 J/cm and the reason of such a use limitation is based on the fact that the toughness of the bond is remarkably excellent as compared with the conventional steels when the welding is carried out with a large heat-input more than 60,000 J/cm.

The present invention will be explained in more detail.

Figure 2:
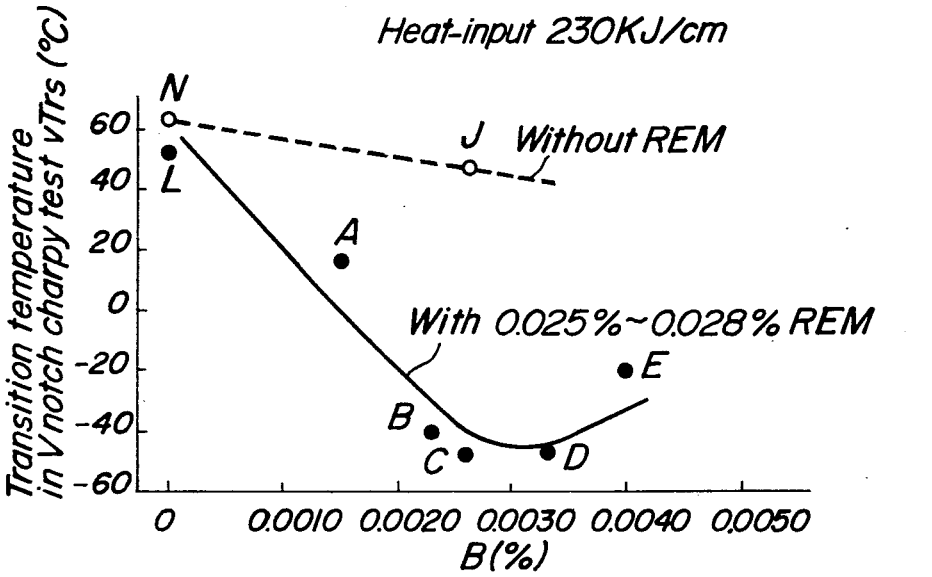
Figure 3:
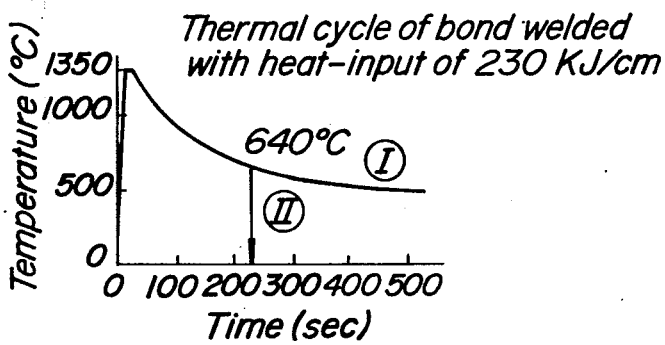
Figure 4:
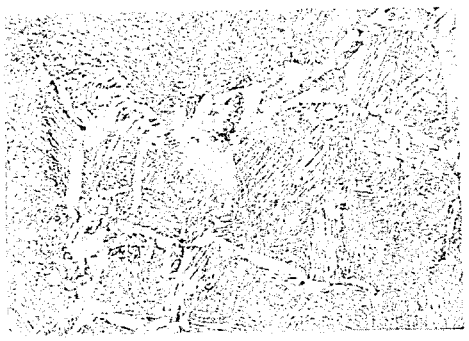
Figure 4:
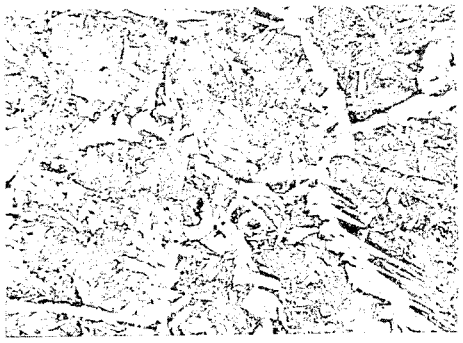
Figure 4:
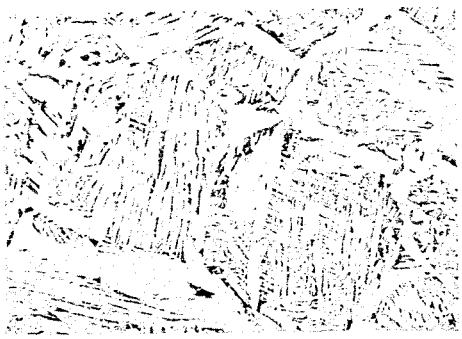
Figure 4:
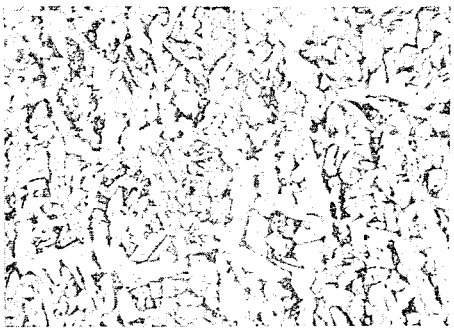
Figure 5:
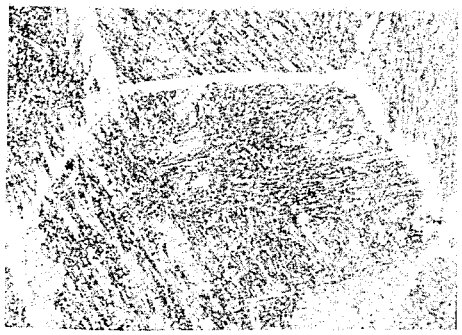
Figure 5:
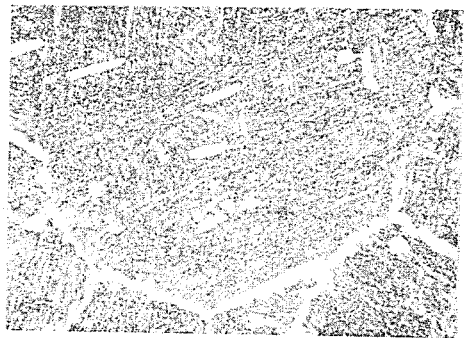
Figure 5:
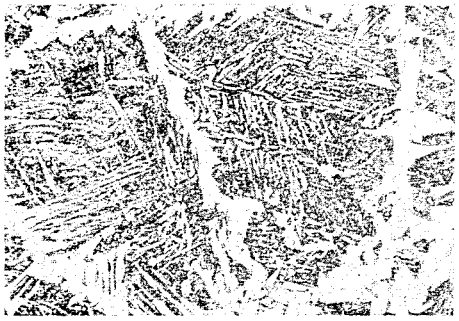
Figure 5:
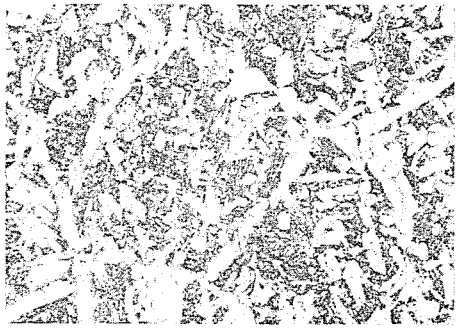

For a better understanding of the invention, reference is taken to the accompanying drawings, wherein:

FIGS. 1 and 2 show the effect of rare earth metal and boron on the notch toughness of the bond welded with the large heat-input (230 KJ/cm), respectively;

FIG. 3 shows the thermal cycle corresponding to the bond welded with a heat-input of 230 KJ/cm; and FIGS. 4 and 5 show the optical microstructures of the bond welded with a heat-input of 230 KJ/cm and the ones when quenched from 640° C in the course of cooling of the thermal cycle, respectively. Here, (a), (b), (c) and (d) show the microstructures of the steel without both boron and rare earth metal, the steel with boron alone, the steel with rare earth metal alone and the steel with both boron and rare earth metal, respectively.

The following examples are given for the purpose of illustration of this invention and are not intended as limitations thereof.

EXAMPLE

Chemical compositions of the hot rolled steel plates used are shown in Table 1. Examination in the bond toughness of single layer welding with a heat-input of 230 KJ/cm are carried out not only by an actual weld joint, but also by a synthetic specimen in the thermal cycle reproduction test.

Table 1

Chemical compositions of the steel plates used: (1) (wt%)

| | Sample No. | C | Si | Mn | P | S | Total R.E.M. | B |
|---|---|---|---|---|---|---|---|---|
| Present invention steel | A | 0.11 | 0.27 | 1.43 | 0.014 | 0.004 | 0.025 | 0.0015 |
| | B | 0.12 | 0.27 | 1.51 | 0.013 | 0.004 | 0.027 | 0.0023 |
| | C | 0.08 | 0.26 | 1.46 | 0.014 | 0.005 | 0.028 | 0.0026 |
| | D | 0.12 | 0.25 | 1.46 | 0.014 | 0.003 | 0.028 | 0.0033 |
| | E | 0.12 | 0.26 | 1.48 | 0.015 | 0.006 | 0.028 | 0.0040 |
| | F | 0.14 | 0.31 | 1.45 | 0.014 | 0.006 | 0.026 | 0.0073 |
| | G | 0.11 | 0.27 | 1.45 | 0.014 | 0.004 | 0.009 | 0.0026 |
| | H | 0.10 | 0.26 | 1.46 | 0.014 | 0.005 | 0.052 | 0.0027 |
| | I | 0.15 | 0.23 | 1.51 | 0.013 | 0.006 | 0.084 | 0.0025 |
| | J | 0.13 | 0.30 | 1.62 | 0.016 | 0.007 | — | 0.0026 |
| Comparative steel | K | 0.13 | 0.32 | 1.55 | 0.012 | 0.005 | 0.115 | 0.0028 |
| | L | 0.12 | 0.26 | 1.48 | 0.014 | 0.004 | 0.027 | — |
| | M | 0.14 | 0.23 | 1.51 | 0.013 | 0.006 | 0.026 | 0.012 |
| Conventionat steel | N | 0.13 | 0.28 | 1.49 | 0.016 | 0.005 | — | — |

Note: R.E.M. : rate earth metal

The mechanical properties of the base metal and the absorbed energy (Eo) and the transition temperature (vTrs) in V-notch Charpy test of the weld bond are shown in Table 2.

Table 2

| | Mechanical properties of base metal and weld bond[1] | | | | | | | |
|---|---|---|---|---|---|---|---|---|
| | | Base plate | | | | | Weld bond of heat-input of 230 KJ/cm | |
| | | JIS No. 4 tensile test piece | | | JIS No. 4 impact test piece | | JIS No. 4 impact test piece | |
| | Sample No. | Y.P. Kg/mm² | T.S. Kg/mm² | El (GL=25) % | Eo Kg·m | νTrs °C | Eo Kg·m | νTrs °C |
| Present invention steel | A | 31.5 | 47.1 | 35 | 30.0 | −36 | 4.0 | 16 |
| | B | 32.4 | 47.8 | 35 | 30.0 | −45 | 30.0 | −40 |
| | C | 27.7 | 42.2 | 38 | 30.0 | −64 | 30.0 | −49 |
| | D | 30.4 | 47.6 | 34 | 28.0 | −37 | 30.0 | −44 |
| | E | 30.8 | 47.0 | 37 | 25.3 | −23 | 30.0 | −21 |
| | F | 32.4 | 50.4 | 34 | 14.5 | −10 | 10.0 | 0 |
| | G | 31.8 | 47.1 | 35 | 30.0 | −49 | 13.8 | −8 |
| | H | 28.9 | 45.5 | 36 | 30.0 | −30 | 25.0 | −34 |
| | I | 34.3 | 52.8 | 33 | 13.5 | −12 | 17.3 | −25 |
| | J | 29.4 | 48.7 | 32 | 20.0 | −23 | 1.8 | 47 |
| Comparative steel | K | 32.8 | 49.0 | 33 | 2.8 | 25 | 3.4 | 30 |
| | L | 33.9 | 49.4 | 38 | 26.8 | −29 | 1.6 | 52 |
| | M | 33.1 | 51.0 | 34 | 3.2 | 33 | 2.5 | 28 |
| Conventional steel | N | 34.5 | 52.2 | 36 | 9.2 | 5 | 1.2 | 63 |

The relations of the contents of rare earth metal and boron to the transition temperatur (νTrs) are shown in FIGS. 1 and 2 respectively by selecting the sample No. in Tables 1 and 2.

The comparative steels J and L are different from the steel of the present invention in view of non-addition of rare earth metal and non-addition of boron respectively. In these comparative steels in which either rare earth metal or boron is added but both rare earth metal and boron are not added, the toughness of the bond in a large heat-input welding is considerably lower and is not substantially different from the conventional steel N which has been heretofore much used.

On the other hand, in the steels where both rare earth metal and boron are present, the toughness of the bond in a large heat-input welding is considerably improved and particularly when rare earth metal and boron coexist in the range of 0.0010 to 0.0050% of boron and 0.010 to 0.050% of rare earth metal, the most preferable result can be obtained The optical microstructures of the (×100) of the bonds when each of the conventional steel (N), the comparative steel (J) with boron alone, the comparative steel (L) with rare earth metal alone and the steel (B) with both boron and rare earth metal is subjected to the thermal cycle corresponding to the bond of a heat-input of 230,000 J/cm following to FIG. 3, are shown in FIG. 4. In order to clarify the formation process of ferrite, the optical microstructures obtained by quenching from 640° C in the cooling course of the above described thermal cycle are shown in FIG. 5.

From the comparison of FIG. 5(-*a*) with FIG. 5(-*b*), it can be seen that the addition of boron has function to precipitate a large number of ferrite in island form in austenite grains. However, the structure (FIG. 4(-*b*) corresponding to the bond in a large heat-input welding is in major part occupied by Widmanstatten ferrite and upper bainite structure and the toughness at a low temperature is poor.

On the other hand, from the comparison of FIG. 5(-*a*) with FIG. 5(-*c*), it can be seen that rare earth metal has the function to form Widmanstatten ferrite independent from the grain boundary in austenite grains and to increase the formation amount of ferrite. However, the structure corresponding to the bond in the large heat-input welding does not remain the upper bainite undesirable for the toughness as in the case of addition of boron but finally becomes coarse Widmanstatten ferrite structure and the notch toughness at a low temperature is poor.

In both addition of boron and rare earth metal, as seen in FIG. 5(-*d*), a larger amount of the fine island-formed ferrite is formed in austenite grains than the case of the addition of boron alone as in FIG. 5(-*b*). The structure corresponding to the bond in the large heat-input welding becomes the fine ferrite-pearlite structure having an excellent toughness as shown in FIG. 4(-*d*).

It is considered that by both the function of boron for forming the fine island-formed ferrite in austenite grains and the function of rare earth metal for promoting the formation of ferrite, the structure corresponding to the bond welded with the large heat-input becomes the mixed structure of fine ferrite and pearlite having an excellent toughness.

The complex function of boron and rare earth metal has been discovered by the inventors and it is very advantageous that the present invention is applied to the weldable steel for the large heat-input welding.

Rare earth metals to be used in the present invention means La, Ce, Pr, Nd, Pm, Sm, Eu, Gd, Tb, Dy, Ho, Er, Tm, Yb and Lu alone or inadmixture. In practice, Misch metal, which is a mixture of rare earth metals, is usually used.

Examples where the selective compositions are contained are shown in the following Table 3.

Table 3 (A)

| | Composition of base metal | | | | | | | |
|---|---|---|---|---|---|---|---|---|
| Sample No. | C | Si | Mn | P | S | Total R.E.M. | B | Al |

Table 3 (A)-continued

| | | Composition of base metal | | | | | | | |
|---|---|---|---|---|---|---|---|---|---|
| | 0 | 0.15 | 0.31 | 1.45 | 0.14 | 0.006 | 0.035 | 0.0024 | 0.035 |
| | P | 0.13 | 0.25 | 1.48 | 0.012 | 0.004 | 0.028 | 0.0022 | — |
| | Q | 0.09 | 0.34 | 1.41 | 0.012 | 0.008 | 0.030 | 0.0025 | — |
| Present invention steel | R | 0.14 | 0.25 | 1.30 | 0.016 | 0.006 | 0.017 | 0.0015 | 0.015 |
| | S | 0.14 | 0.18 | 1.45 | 0.017 | 0.005 | 0.029 | 0.0013 | 0.031 |
| | T | 0.13 | 0.28 | 1.46 | 0.014 | 0.005 | 0.013 | 0.0025 | — |
| | U | 0.13 | 0.22 | 1.45 | 0.015 | 0.006 | 0.026 | 0.0025 | — |
| | W | 0.12 | 0.26 | 1.45 | 0.015 | 0.004 | 0.032 | 0.0030 | 0.021 |
| Conventional steel | V | 0.13 | 0.36 | 1.42 | 0.020 | 0.008 | — | — | 0.023 |

| | Sample No. | Nb | V | Cu | Ni | Cr | Mo | Ti | Zr | Se |
|---|---|---|---|---|---|---|---|---|---|---|
| | 0 | — | — | — | — | — | — | — | — | — |
| | P | — | 0.03 | — | — | — | — | — | — | — |
| | Q | — | 0.04 | 0.17 | 0.21 | — | — | — | — | — |
| Present invention steel | R | 0.03 | — | — | — | 0.22 | — | — | — | — |
| | S | — | — | — | — | — | 0.18 | — | — | — |
| | T | — | — | — | — | — | — | 0.017 | — | — |
| | U | — | — | — | — | — | — | — | 0.03 | — |
| | W | — | — | — | — | — | — | — | — | 0.03 |
| Conventional steel | V | — | 0.04 | — | 0.21 | — | — | — | — | — |

Table 3 (B)

| | | Base metal | | | | | Weld bond of heat-input of 230 KJ/cm | |
|---|---|---|---|---|---|---|---|---|
| | | JIS No. 4 tensile test piece | | | JIS No. 4 impact test piece | | JIS No. 4 impact test piece | |
| | Sample No. | Y.P. Kg/mm² | T.S. Kg/mm² | El (GL=25) % | Eo Kg·m | νTrs °C | Eo Kg·m | νTrs °C |
| | 0 | 33.8 | 51.0 | 35 | 30.0 | −50 | 30.0 | −42 |
| | P | 35.0 | 53.7 | 36 | 27.0 | −40 | 25.0 | −30 |
| | Q | 41.2 | 53.2 | 35 | 25.0 | −35 | 21.3 | −25 |
| Present invention steel | R | 45.0 | 57.6 | 31 | 26.2 | −30 | 24.6 | −28 |
| | S | 40.2 | 58.5 | 32 | 20.3 | −15 | 20.0 | −32 |
| | T | 39.8 | 57.7 | 31 | 28.1 | −35 | 25.2 | −28 |
| | U | 33.0 | 50.2 | 35 | 30.0 | −40 | 30.0 | −38 |
| | W | 33.5 | 50.3 | 33 | 30.0 | −42 | 26.3 | −30 |
| Conventional steel | V | 44.3 | 55.0 | 32 | 30.0 | −52 | 2.3 | 53 |

In this case, it can be also seen that the coexisting effect of rare earth metal and boron is kept.

The weldable steels of the present invention is excellent in the toughness of the bond, when the large heat-input welding is carried out, without being influenced by the heat treatment of the base plate. One example is shown in the following Table 4.

Table 4

| Mechanical properties of base metal and weld bond[3] | | | | | | | | | |
|---|---|---|---|---|---|---|---|---|---|
| | | | Base metal | | | | | Weld bond of heat-input of 230 KJ/cm | |
| | | | JIS No. 4 tensile test piece | | | JIS No. 4 impact test piece | | JIS No. 4 impact test piece | |
| | Sample No. | | Y.P. Kg/mm² | T.S. Kg/mm² | El % | Eo Kg·m | νTrs °C | Eo Kg·m | νTrs °C |
| present invention steel | B | Hot rolled steel | 32.4 | 47.8 | 35 | 30.0 | −45 | 30.0 | −40 |
| | | Normalized steel[1] | 32.0 | 48.0 | 34 | 30.0 | −60 | 28.2 | −38 |
| | | quenched-tempered steel[2] | 48.0 | 62.3 | 33 | 22.8 | −65 | 25.0 | −40 |

Note;
[1]Held at 920° C followed by air cooling
[2]Held at 920° C followed by water cooling
→ held at 580° C followed by air cooling From the above table it can be seen that any of the hot rolled steel, the normalized steel and the quenched-tempered steel are excellent in the toughness of the bond. Namely, the coexisting effect of rare earth metal and boron is not substantially influenced by the pretreatment of the base plate. This is advantageous when the steel plate is heat-treated to improve the level of strength.

Then, the toughness of the weld bond when the heat-input for welding is varied, was measured with respect to the present invention steel (B) and the conventional steel (N). The results are shown in the following Table 5.

Table 5

| | Relationship between amount of heat-input and bond toughness (0° C, Kg·m) | | | | |
|---|---|---|---|---|---|
| | Sample No. | 30 KJ/cm | 60 KJ/cm | 100 KJ/cm | 230 KJ/cm |
| Present invention steel | B | 6 | 10 | 25 | 30 |
| Conventional steel | N | 5 | 4 | 3 | 3 |

In the conventional steel N, as the amount of heat-input increases, the toughness of the bond lowers, while in the present invention steel B, as the amount of heat-input increases, the toughness is more and more improved and particularly in the amount of heat-input more than 60,000 J/cm, the effect is remarkable.

Thus, when the weldable steel is used for building of a large size structure by an automatic welding with a large heat-input, the deterioration of the toughness which has been inevitable in the weld bond can be advantageously prevented even in the single layer welding, so that the present invention can considerably contribute to the reduction of the number of welding steps and welding cost and to the improvement of the welding efficiency.

What is claimed is:

1. A weldable hot-rolled steel capable of forming a tough bond after single layer large heat-input welding of more than 60,000 J/cm comprising 0.05 to 0.18% of carbon, 0.02 to 0.80 of silicon and 0.70 to 1.70% of manganese in coexistence with 0.010 to 0.050% of rare earth metal and 0.0010 to 0.0050% of boron, with the amount of phosphorus and sulphur being limited to not more than 0.035% and not more than 0.015% respectively, the remainder being iron.

2. A weldable steel capable of forming a tough bond after single layer large heat-input welding of more than 60,000 J/cm comprising 0.05 to 0.18% of carbon, 0.02 to 0.80 silicon and .70 to 1.70% of manganese is coexistence with 0.010 to 0.050% of rare earth metal and 0.0010 to 0.0050% of boron, with the amount of phosphorus and sulphur being limited to not more than 0.035% and not more than 0.015% respectively, said steel further containing at least one member of a group consisting of not more than 0.03% of niobium, not more than 0.05% of vanadium, not more than 0.3% of copper, not more than 0.6% of nickel, not more than 0.6% of chromium, not more than 0.1% of molybdenum, not more than 0.1% of selenium, not more than 0.1% of aluminum, not more than 0.04% of titanium, and not more than 0.04% of zirconium, the remainder being substantially iron.

* * * * *